US006000633A

United States Patent [19]

Lund et al.

[11] Patent Number: 6,000,633

[45] Date of Patent: Dec. 14, 1999

[54] SPRAY NOZZLE FOR ANTI-CLOG SPRAY PACKAGE

[75] Inventors: Mark Thomas Lund, West Chester; William Scott Andes, Springfield, both of Ohio

[73] Assignee: The Proctor & Gamble Company, Cincinnati, Ohio

[21] Appl. No.: 09/052,632

[22] Filed: Mar. 31, 1998

[51] Int. Cl.[6] ..... B05B 1/00; B05B 7/32

[52] U.S. Cl. ..... 239/211; 239/104; 239/106; 239/337; 239/589; 239/601; 239/602; 222/78; 222/108; 222/571; D9/448; D9/449; D9/524

[58] Field of Search ..... 239/104, 106, 239/120, 121, 211, 337, 288, 589, 601, 602; D9/448, 449, 524; 222/78, 108, 571, 575

[56] References Cited

U.S. PATENT DOCUMENTS

| | | | |
|---|---|---|---|
| D. 294,682 | 3/1988 | McLean | D9/448 |
| D. 356,249 | 3/1995 | Abfier et al. | D9/300 |
| 2,781,950 | 2/1957 | Pritchard | 222/82 |
| 3,033,473 | 5/1962 | Kitabayashi | 239/579 |
| 3,079,048 | 2/1963 | Wolfson et al. | 222/108 |
| 3,149,761 | 9/1964 | Harris et al. | 222/394 |
| 3,346,195 | 10/1967 | Groth | 239/337 |
| 3,711,031 | 1/1973 | Ewald | 239/601 |
| 3,785,571 | 1/1974 | Hoening | 239/492 |
| 3,838,822 | 10/1974 | Ewald | 239/596 |
| 5,137,180 | 8/1992 | Kieras | 222/108 |
| 5,314,123 | 5/1994 | Miller | 239/708 |
| 5,395,050 | 3/1995 | Nowak et al. | 239/121 |
| 5,676,311 | 10/1997 | Hartman | 239/120 |
| 5,687,877 | 11/1997 | Smolen, Jr. | 222/571 X |

FOREIGN PATENT DOCUMENTS

| | | |
|---|---|---|
| 2 276 101 | 9/1994 | United Kingdom . |
| WO9521699 | 8/1995 | WIPO . |

*Primary Examiner*—Andres Kashnikow
*Assistant Examiner*—Robin O. Evans
*Attorney, Agent, or Firm*—William Scott Andes; Jack L. Oney, Jr.

[57] ABSTRACT

The present invention provides a spray nozzle with both desirable aesthetic and functional attributes. The spray nozzle includes a central orifice and a plurality of blind recesses concentrically disposed around the central orifice, as well as an annular channel connecting all of the blind recesses. The recesses and the channel each individually provide desirable aesthetic properties, while in combination they each reduce the likelihood of product residue buildup in the other. The recesses interrupt the smooth walls of the channel to divert liquid product out of the channel before it can dry out.

19 Claims, 3 Drawing Sheets

SPRAY NOZZLE FOR ANTI-CLOG SPRAY PACKAGE

FIELD OF THE INVENTION

The present invention relates to spray nozzles for spray packages. The present invention further relates to spray nozzles for spray packages which incorporate anti-clog features.

BACKGROUND OF THE INVENTION

Hair spray packages are typically either the manually actuated pump type or the aerosol type. Sprays formed from aerosols rely on a liquefied propellant to "flash off" for creating the spray, while manually actuated pump sprayers generate a hydraulic pressure which shears the liquid in the nozzle so as to create ligaments and droplets, i.e., the spray.

One of the major problems that consumers deal with when using manually actuated pumps is clogging. Clogs typically occur in the nozzle when product dries out behind and in front of the nozzle orifice insert, thereby causing a blockage which may be either full or partial. Full blockages completely interrupt flow, whereas partial blockages will typically block one or more swirl vanes resulting in a very irregular and coarse spray.

While spray packages have been developed which incorporate anti-clog features, anti-clog spray nozzles typically have few if any external design features due to the difficulty such features present in terms of providing opportunities for product residue to accumulate. Without such external design features, most spray nozzles are very simple and have a mechanical appearance, thus tending to convey an illusion of directed discharge of the product rather than a soft spray pattern.

Accordingly, it would be desirable to provide a spray nozzle suitable for use in anti-clog type spray packages which includes external design features while minimizing the likelihood of product accumulation.

SUMMARY OF THE INVENTION

The present invention provides a spray nozzle with both desirable aesthetic and functional attributes. The spray nozzle includes a central orifice and a plurality of blind recesses concentrically disposed around the central orifice, as well as an annular channel connecting all of the blind recesses. The recesses and the channel each individually provide desirable aesthetic properties, while in combination they each reduce the likelihood of product residue buildup in the other. The recesses interrupt the smooth walls of the channel to divert liquid product out of the channel before it can dry out.

BRIEF DESCRIPTION OF THE DRAWINGS

While the specification concludes with claims particularly pointing out and distinctly claiming the subject invention, it is believed the same will be better understood from the following description taken in conjunction with the accompanying drawings, in which like numerals identify like elements, and in which:

DETAILED DESCRIPTION OF THE INVENTION

Figure 1:
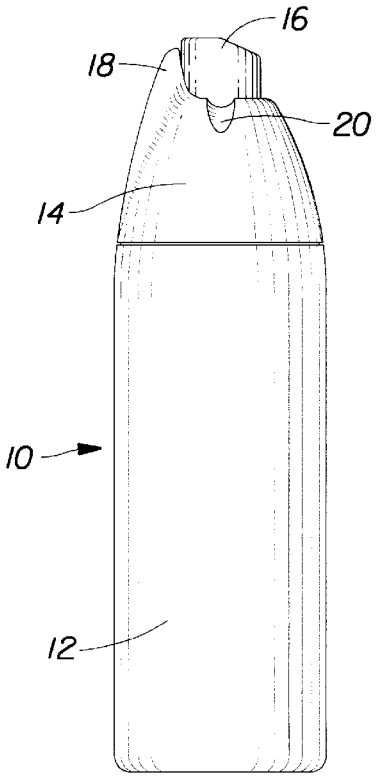
FIG. 1 is an elevational view of a spray package employing a spray nozzle of the present invention.

Referring now to the drawings, FIG. 1 illustrates an elevational view of a spray package 10 suitable for use with a spray nozzle of the present invention. Specifically shown are container body 12, shroud 14, and actuator 16. Container body 12 is typically a one-piece plastic blow-molded bottle, but may be made of metal, or any other material known to the art, and may be made in multiple parts if need be. Actuator 16 and shroud 14 are typically plastic injection-molded parts, but also may be made of other materials, and in multiple parts. Shroud 14 masks an underlying threaded closure, provides for anti-clog wiper 18, and also provides a new and different look for a spray container.

Figure 3:
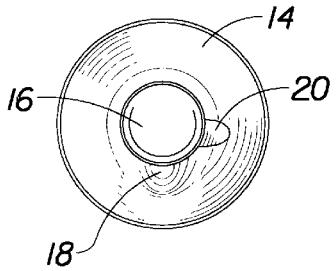
FIG. 3 is a plan view of the package of FIG. 1.
Figure 2:
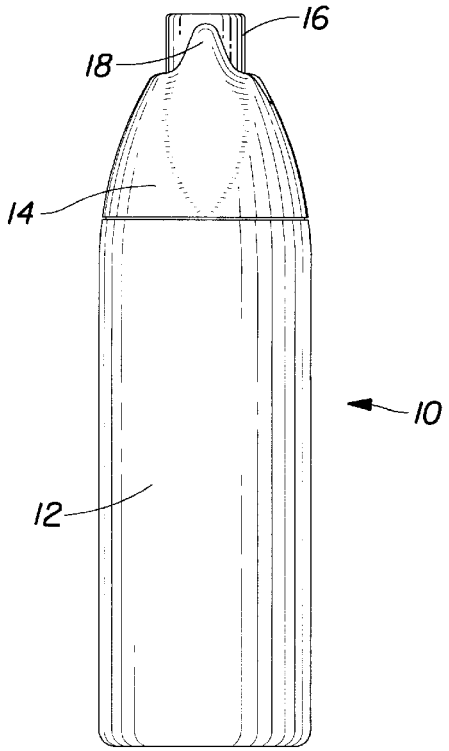
FIG. 2 is the elevational view of the spray package of FIG. 1, turned 90 degrees about its longitudinal axis.

In this view, the spray nozzle of actuator 16 is facing into the anti-clog wiper 18 which extends upwardly from the top of shroud 14. This corresponds both to the position in which the actuator is locked and dispensing cannot take place, and the position in which the nozzle is sealed by anti-clog wiper 18 so that product will not dry out and clog within the nozzle. Notch 20 indicates the unlock position which actuator 16 may be turned to for dispensing product; this position is approximately 80 to 90 degrees from the position of anti-clog wiper 18 so that wiper 18 will not interfere with the user's finger during actuation. FIG. 2 shows a head-on view of wiper 18, and FIG. 3 is a plan view showing the positions of wiper 18 and notch 20 approximately 80 to 90 degrees from each other.

Figure 4A:
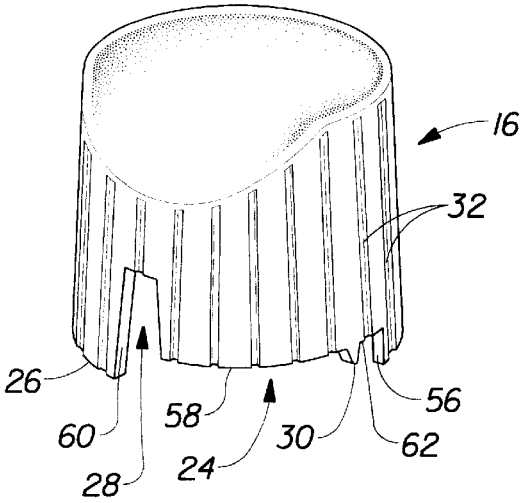
FIG. 4*a* is a perspective elevational view of an actuator employing a spray nozzle of the present invention, showing a portion of the locking mechanism.
Figure 4B:
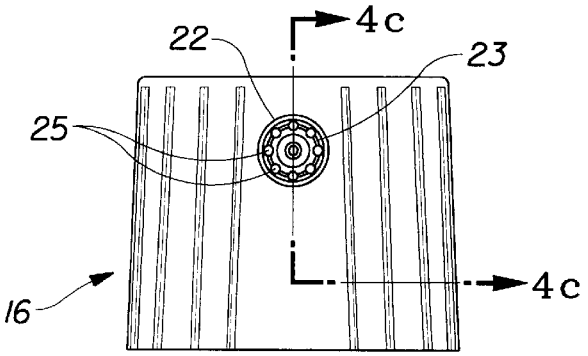
FIG. 4*b* is an elevational view of the actuator of FIG. 4*a* showing the spray nozzle of the present invention.

FIGS. 4*a* and 4*b* are exploded views of actuator 16, showing spray nozzle 22 of the present invention which is inserted into a sleeve within actuator 16 and which swirls the fluid product to create a spray of a predetermined quality. Also included on actuator 16 is a cutout area 24, which extends approximately 80 to 90 degrees around the actuator skirt 26 to allow rotational movement of actuator 16 between the locked and unlocked positions. Actuator slot 28 provides for the unlocked position, and has a height equal to the stroke length of the pump. The side walls of slot 28 may be slightly tapered to allow a stop (38 in FIG. 6) to easily ride within slot 28. Tab 30 provides for a "click" sound when actuator 16 is put into the locked position, to notify the user. The function of cutout area 24 will be described in more detail below. Ribbing 32 may be added to the sidewalls of actuator 16 for better gripping during rotation between the locked and unlocked positions.

As shown in FIG. 4*b*, the spray nozzle 22 of the present invention includes a plurality of recesses 25 which are interconnected by a channel 23. The recesses 25 are "blind recesses", i.e., they have only one open end in the face of the spray nozzle and extend inwardly into the material of the nozzle. Such recesses do not function to dispense any product, as they would if they completely penetrated the nozzle material and exposed the product supply channel(s) behind the nozzle. Recesses 25 provide an aesthetic benefit from a consumer perspective because they convey the visual impression of a shower head with a multitude of small dispensing orifices, even though the product is only delivered via the central orifice. Recesses 25 are preferably substantially concentrically disposed radially outwardly of the central orifice and are preferably substantially equally spaced around the central orifice. While in a preferred embodiment the recesses have a circular cross-section in the plane of the nozzle face, recesses can have any cross-sectional shape desired. Any desired number of recesses may be employed depending upon their size and the size of the other features and surfaces of the spray nozzle, with eight recesses of a diameter approximately equal to the diameter of the central orifice having proven successful in use.

Figure 4C:
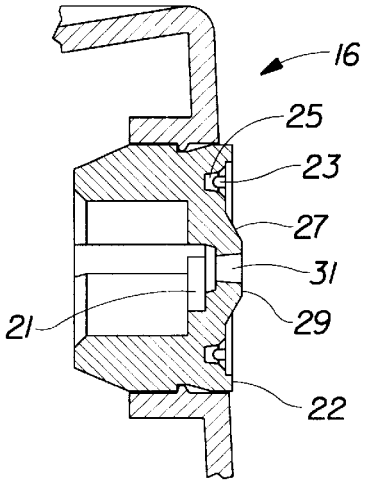
FIG. 4*c* is an elevational sectional view of the spray nozzle of FIG. 4*b* taken along section line 4*c*—4*c;*

With reference to both FIGS. 4*b* and 4*c*, the spray nozzle 22 includes a central orifice 31, which is in fluid communication with a swirl chamber 21 and the internal fluid passageways of the actuator. For some applications, depending upon product formulations and operating pressures it may be desirable to omit a swirl chamber in favor of a more direct fluid pathway. The central orifice 31 preferably extends outwardly of the nozzle face and is formed in and surrounded by a substantially conical surface 27 which culminates in a substantially planar surface 29 immediately adjacent to the central orifice 31. The conical surface 27 and planar surface 29 interact with anti-clog wiper 18 to form a point seal which closes the central orifice and prevents product dry-out within the fluid passageways of the nozzle and actuator.

The spray nozzle 22 further includes a channel 23 which interconnects the recesses 25. The channel 23 provides an aesthetic benefit in that it breaks up the otherwise flat geometry of the nozzle face between the base of the conical surface and the outer periphery of the nozzle, and tends to draw the viewer's attention to the recesses. In addition, the recesses serve to interrupt the otherwise smooth, continuous surfaces of the channel and are believed to aid in diverting liquid product out of the channel rather than allowing the product to pool within the channel. Accordingly, while the recesses and channel have individual and collective aesthetic qualities, together they are believed to act synergistically to reduce the likelihood of product residue accumulating within these features. Moreover, the extension of the central orifice outwardly beyond the channel and recesses is also believed to reduce product residue accumulation at the orifice. While the channel may be of any desired size, it is preferred that the channel be smaller in width and depth than the recesses so as to accentuate the appearance of the recesses. Dimensions of approximately half the width and half the depth of the recesses have proven successful in use.

While a preferred embodiment includes a single concentric annular row of recesses connected by a single concentric annular channel, it should be understood that the spray nozzles of the present invention depending upon the overall size of the spray nozzle may employ multiple concentric annular rows of recesses with each row being interconnected by a concentric annular channel, whether the recesses of successive rows are radially aligned or not.

By way of illustration only, a representative spray nozzle in insert form in accordance with FIGS. 4*b* and 4*c* was injection molded from acetal resin having a central orifice having a diameter of about 0.016 inches, surrounded by a circular channel of about 0.008 inches width, about 0.008 inches depth (fully radiused at maximum depth), and about 0.130 inches diameter (on center). Eight blind recesses were provided, each having a depth of about 0.015 inches (flat bottomed at maximum depth) and a diameter of about 0.015 inches, with each being chamfered at the outer surface.

While the spray nozzle 22 has been described with regard to a nozzle insert suitable for use with a button-type actuator, it should be understood that the principles of the present invention are equally applicable to other nozzle configurations, such as unitary nozzle constructions. In addition, the spray nozzles of the present invention may find equal applicability to pressurized aerosol propellant delivery systems as well as the manually-operated delivery systems described herein.

Figure 5:
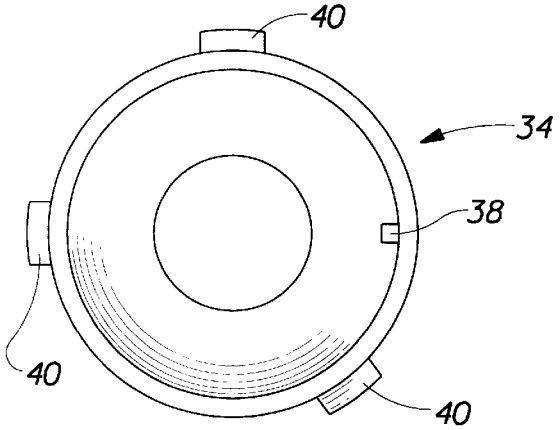
FIG. 5 is a plan view of a spray package closure suitable for use with the actuator of FIG. 4*a;*
Figure 6:
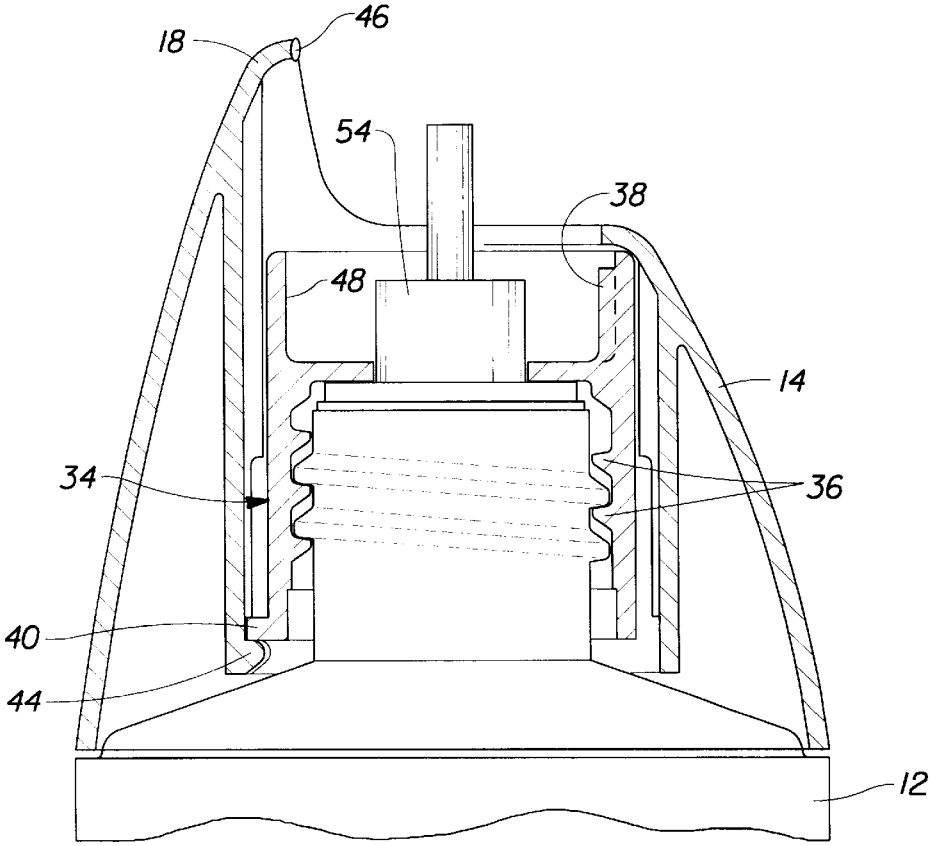
FIG. 6 is an elevational view of the closure of FIG. 5, along with an elevational cross-section of the shroud.

FIGS. 5 and 6 show plan and elevational views of closure 34 respectively. Closure 34 is hidden by shroud 14 when package 10 is assembled. Closure 34 contains threads 36 which enable closure 34 to be torqued onto container body 12. Threads 36 may be provided with some type of stop (not shown) that engages with a stop on the threads of body 12 to enable closure 34 to be stopped at a certain rotational position, in which wiper 18 will align with a label on body 12 in a predetermined position. Included on the inner hub of closure 34 is actuator stop 38 which cooperates with cutout area 24 on actuator 16 to provide for the lock/unlock mechanism. The width of stop 38 corresponds to the width of slot 28 so that stop 38 may easily ride up and down within slot 28 when actuator 16 is in the unlocked position. The position of the top of stop 38 corresponds with the height of slot 28 and the stroke length of the pump. A series of lugs 40 are provided on the outside of closure 34 which cooperate with latches 44 of shroud 14 to secure shroud 14 to closure 34. Lugs 40 may be positioned such that shroud 14 may be secured to closure 34 in only one predetermined position, when a specific orientation between closure 34 and shroud 14 is desired. Note that in FIG. 5, two of the lugs 40 are 90 degrees from each other, whereas the third lug 40 is approximately 135 degrees from each of the other two. If the latches 44 are positioned to match the lug pattern, shroud 14 may only be attached to closure 34 in one specific orientation.

FIG. 6 also shows a sectional view through shroud 14. Again, specific predetermined positioning of latches 44 and lugs 40 allows shroud 14 to be attached to closure 34 in a specific predetermined orientation. Wiper 18 has bead 46 on its tip, for engagement with nozzle 22 when actuator 16 is in the locked position. Actuator 16 slides up and down within sleeve 48 during actuation.

Figure 7:
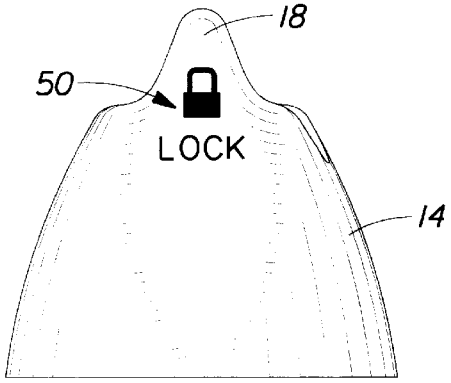
FIG. 7 is an elevational view of the shroud corresponding to the view shown in FIG. 2.
Figure 8:
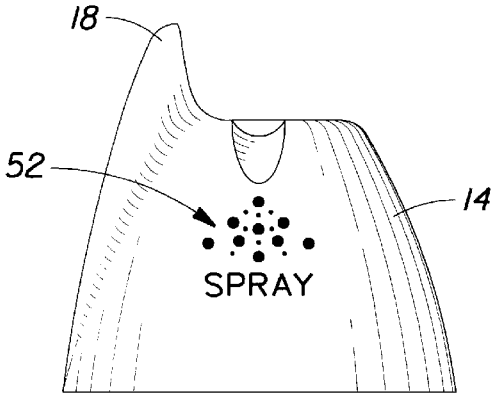
FIG. 8 is an elevational view of the shroud corresponding to the view shown in FIG. 1.

FIGS. 7 and 8 show shroud 14 with indicia 50 and 52, which may be provided to show the locked and unlocked positions for actuator 16 respectively. When actuator 16 is turned so nozzle 22 faces wiper 18, the package is locked. When actuator 16 is turned so nozzle 22 is exposed above notch 20, the package is unlocked.

During assembly, nozzle 22 is placed inside of actuator 16 using conventional means. Similarly, pump cartridge 54 (FIG. 6) is placed into closure 34 using conventional means. Actuator 16 is then placed onto pump cartridge 54 so that it is oriented corresponding to the locked position. This position puts actuator stop 38 between tab 30 and surface 56 (FIG. 4*a*) when actuator 16 is fully assembled onto pump cartridge 54. Next, shroud 14 is assembled onto closure 34 such that lugs 40 are aligned with latches 44; this puts bead 46 into contact with nozzle 22 when shroud 14 is fully in place on package 10. This completed unit is then attached to container body 12, after body 12 has been filled with product. As stated earlier, thread stops may be employed to orient wiper 18 with respect to a package label in a specific predetermined orientation.

To dispense product, actuator 16 is gripped using the thumb and index finger, and is rotated counterclockwise so as to expose nozzle 22 and put it in a location directly above notch 20. At this time the top of actuator stop 38 rides past tab 30 and along surface 58, until stop 38 hits surface 60. At this point stop 38 is free to ride up and down within slot 28 when actuator 16 is depressed, and actuation may take place. When actuator 16 is not depressed, the top of stop 38 is at a position slightly below surface 58.

When finished, actuator 16 may be rotated clockwise; when the top of stop 38 passes tab 30, an audible "click" occurs which notifies the user that package 10 is locked and nozzle 22 is sealed. In this position, the top of stop 38 hits surface 62 if a user attempts to depress actuator 16, and spraying cannot take place.

Alternative embodiments of this device include those in which actuator 16 is provided with a male component instead of the female components shown in FIG. 4; in this case, closure 34 would be provided with the female components corresponding to that shown on actuator 16 in FIG. 4 instead of stop 38. Also, instead of providing the device so that actuator 16 is turned to accomplish locking and unlocking, the device may be provided so that shroud 14 is turned to accomplish locking and unlocking. Additionally, the seal between bead 46 and nozzle 22 may be achieved if both nozzle 22 and bead 46 are flat, if nozzle 22 is convex and bead 46 is concave, if nozzle 22 is concave and bead 46 is convex, or just about any combination of these various shapes.

U.S. Pat. No. 5,560,544, incorporated by reference herein, discloses a spray nozzle made with reduced wettability materials. These materials ensure that product will tend to bead up on the nozzle surfaces, rather than to coat the surfaces, thereby reducing the incidence of clogging. Such materials may be used with the present invention to improve overall anti-clogging of the nozzle.

While particular embodiments of the present invention have been illustrated and described herein it will be obvious to those skilled in the art that various changes and modifications can be made without departing from the spirit and scope of the present invention and it is intended to cover in the appended claims all such modifications that are within the scope of this invention.

What is claimed is:

1. A spray nozzle for dispensing and atomizing a liquid product, said spray nozzle having an outer surface with a central orifice and a plurality of blind recesses surrounding said central orifice, said spray nozzle further including a channel interconnecting said recesses.

2. The spray nozzle of claim 1, wherein said outer surface includes a conical surface surrounding said central orifice, said recesses and said channel being located radially outwardly of said conical surface.

3. The spray nozzle of claim 1, wherein said recesses are deeper than said channel.

4. The spray nozzle of claim 2, wherein said conical surface includes a substantially planar surface surrounding said central orifice.

5. The spray nozzle of claim 1, wherein said recesses are equally spaced around said central orifice.

6. The spray nozzle of claim 1, wherein said recesses are concentrically arranged around said central orifice.

7. The spray nozzle of claim 1, wherein said spray nozzle includes eight recesses.

8. The spray nozzle of claim 1, wherein said recesses have chamfered edges.

9. The spray nozzle of claim 1, wherein said recesses have a substantially circular cross-section.

10. The spray nozzle of claim 1, wherein said central orifice extends outwardly of said spray nozzle beyond said recesses.

11. The spray nozzle of claim 1, wherein said spray nozzle comprises a nozzle insert.

12. The spray nozzle of claim 1, wherein said spray nozzle includes a swirl chamber.

13. The spray nozzle of claim 1, wherein said recesses form a single concentric annular row of recesses interconnected by a single annular concentric channel.

14. The spray nozzle of claim 1, wherein said channel is annular and is concentrically oriented with respect to said central orifice.

15. A spray nozzle for dispensing and atomizing a liquid product, said spray nozzle having an outer surface with a central orifice and a plurality of blind recesses forming surrounding said central orifice, said spray nozzle further including a channel interconnecting said recesses, said recesses forming a single concentric annular row of recesses interconnected by a single annular concentric channel, said recesses being deeper than said channel and having a substantially circular cross-section.

16. A spray package for dispensing and atomizing a liquid product, said spray package comprising a container and a spray nozzle in fluid communication with said container for dispensing and atomizing said liquid product, said spray nozzle having an outer surface with a central orifice and a plurality of blind recesses surrounding said central orifice, said spray nozzle further including a channel interconnecting said recesses.

17. The spray package of claim 16, wherein said spray package comprises a manually-operated delivery system.

18. The spray package of claim 16, wherein said spray package comprises an aerosol propellant delivery system.

19. The spray package of claim 16, wherein said liquid product comprises a hair spray product.

* * * * *